US005180874A

United States Patent [19]

Troncoso, Jr

[11] Patent Number: 5,180,874

[45] Date of Patent: Jan. 19, 1993

[54] HANDGUN BRACE AND ASSEMBLY

[76] Inventor: Fernando Troncoso, Jr, 14090-6100 Rd., Montrose, Colorado, Colo.

[21] Appl. No.: 751,551

[22] Filed: Aug. 29, 1991

[51] Int. Cl.[5] ..... F41C 23/12

[52] U.S. Cl. ..... 042/72; 42/71.02; 42/94; 42/74; 89/37.04

[58] Field of Search ..... 42/71.02, 94, 72, 74; 89/37.04, 1.42

[56] References Cited

U.S. PATENT DOCUMENTS

| | | | |
|---|---|---|---|
| 1,569,901 | 1/1926 | Virdin | 42/72 |
| 3,685,194 | 8/1972 | Coon | 42/72 |
| 4,438,581 | 3/1984 | LaValle | 42/94 |
| 4,858,359 | 9/1989 | Danz | 42/94 |
| 5,070,636 | 12/1991 | Mueller | 42/94 |

FOREIGN PATENT DOCUMENTS

| | | | |
|---|---|---|---|
| 861284 | 2/1941 | France | 42/94 |

OTHER PUBLICATIONS

Freedom Arms, Steady Arm(Guns and Ammo), 1983, p. 25.

*Primary Examiner*—Stephen M. Johnson

*Attorney, Agent, or Firm*—Donald E. Nist

[57] ABSTRACT

The improved handgun assembly of the present invention includes a handgun with barrel and a butt having a handgrip, and a novel handgun brace resting against but otherwise unconnected to the handgun. The brace is in the form of a unitary rod having an upraised front portion, an intermediate portion connected thereto and sloping downwardly and rearwardly therefrom, and a rear portion connected to the intermediate portion and extending downwardly and rearwardly therefrom. The front portion bears an upraised, preferably detachable fork which holds the gun barrel. The fork may be stepped to accommodate gun barrels of various diameters. The intermediate portion includes a palm rest and a gun butt holder. The palm rest and holder may be in form of a single tube with an elongated recess into which the butt fits. There may be an elongated bottom slot in the tube up thru which a slideable stop pin fits to brace the back of the gun butt. The rear portion of the rod includes a forked arm or wrist grip, to which may be releasably connected a rear extension bearing a forked forearm- or upper arm- brace. The assembly is light weight, compact and effective to steady a shooter's aim, principally for hunting purposes.

4 Claims, 1 Drawing Sheet

HANDGUN BRACE AND ASSEMBLY

FIELD OF THE INVENTION

The present invention generally relates to firearms and more particularly to an improved handgun assembly employing a novel handgun brace.

PRIOR ART

Handguns normally are held in one hand while they are being aimed and fired. However, for certain types of handgun competition, such as police combat tournaments, normally the handguns are held in one hand, but that hand is braced by the other hand. Specifically, the wrist of the firing hand is tightly gripped by the shooter's other hand. This helps to steady the gun and improve the shooter's score. Police when confronting criminals frequently use this two-handed grip in holding the gun.

Various other devices have been provided to steady a handgun shooter's aim. Thus, wrist bands, broad in dimensions and tightly applied to the shooting wrist, help to keep that wrist in a fixed position. This has two effects: it causes a steadier aim with better scoring; and, in the case of automatics, it prevents a collapsing wrist which absorbs and deflects the gun recoil and which frequently results in cartridge extraction jams, due to the reduced recoil. However, for regular pistol competitions, wrist wraps usually are not allowed.

When a handgun enthusiast is using a single shot high powered pistol either for target shooting or for game hunting, it is especially desirable to make each shot count with the greatest accuracy. While the wrist wrap has some benefit, it would be desirable to be able to provide a simple and efficient means of further improving handgun shooting accuracy.

In recent years, much resort has been made to handgun-mounted telescopes, usually having a magnification of about 2–4 power. However, although aiming accuracy is increased, the magnification of the target multiplies the difficulty in holding the handgun on the target. Any means which could reduce the wobble in aiming telescope-equipped handguns would be greatly appreciated by handgun enthusiasts, whether using single-shot guns or revolvers or automatics. It would be desirable if such aim-improving means were simple, efficient, low in cost, durable and light in weight.

SUMMARY OF THE INVENTION

The improved handgun assembly of the present invention incorporates a novel handgun brace which improves shooting accuracy and satisfies all the foregoing needs.

The assembly is substantially as set forth in the Abstract of the Disclosure. Thus, the assembly includes a handgun with barrel, body and a butt which includes a grip. Resting against the gun is the improved handgun brace. Thus, the brace comprises an elongated rod having an upraised front portion, an intermediate portion connected thereto and sloping down and rearwardly of the front portion, and a rear portion connected to the intermediate portion and sloping down and rearwardly thereof.

Means in the form of a fork are connected, preferably releasably, to the front portion and extend up to hold the handgun barrel. The fork can be stepped to accommodate gun barrels of various dimensions.

The intermediate portion includes a palm rest for the shooter's non-shooting hand to grip or otherwise hold. It also includes a butt holder. Thus, the intermediate portion can be in the form of a generally elongated tube which is easy to grip and the upper portion of which is hollowed out to provide a recess in which the gun butt is seated. The tube may have an elongated slot in the bottom communicating with the recess and up through which extends a pin abutting the rear end of the gun butt. The pin is releasably locked in any position along the slot.

The rear portion of the rod includes a rear brace in the form of a fork. The fork can be shaped to grip either the shooting wrist or the shooting forearm. In some instances, a rear extension is releasably connected to the rear end of the rod, so that the rear rod fork can grip the wrist while a similar fork on the rear end of the extension grips either the shooting forearm or upper arm.

The assembly is light in weight and can be made essentially unitary and of any suitable material such as aluminum or wood. Further features of the improved assembly and handgun brace of the present invention are set forth in the following detailed description and accompanying drawings.

DRAWINGS

DETAILED DESCRIPTION

FIGS. 1 AND 2.

Figure 1:
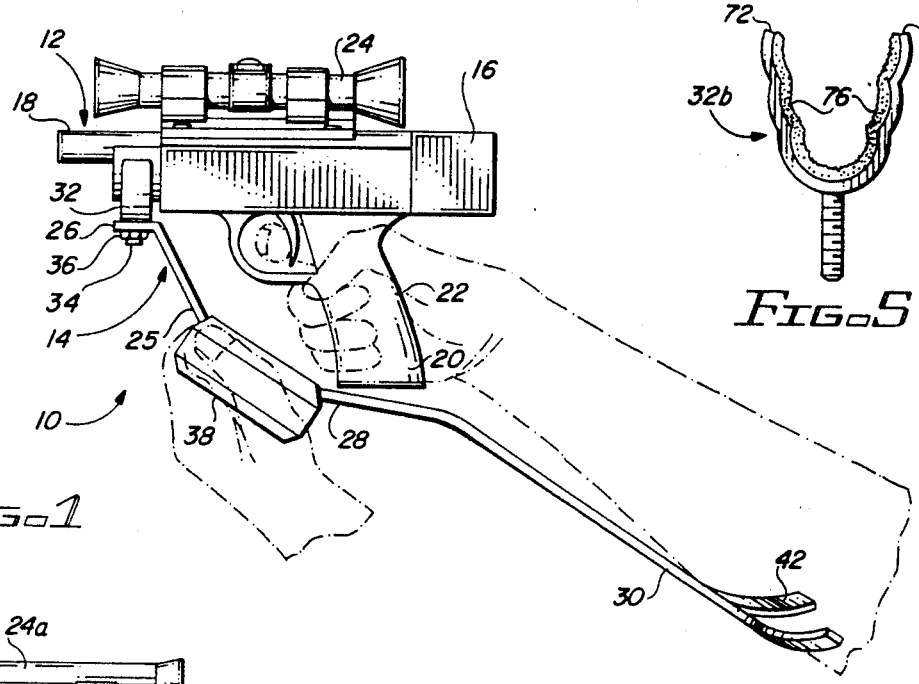
FIG. 1 is a schematic side elevation of a first preferred embodiment of the improved handgun assembly of the present invention, shown with the assembly held by a handgun shooter for firing.
Figure 2:
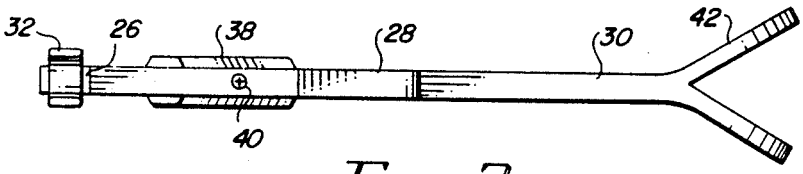
FIG. 2 is a schematic top plan view of the handgun brace utilized in and forming part of the assembly of FIG. 1.
Figure 4:
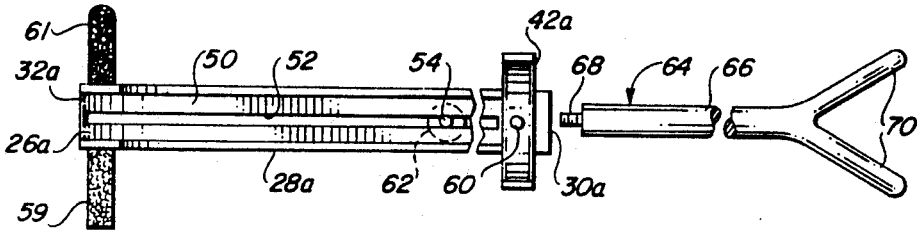
FIG. 4 is a schematic fragmentary top plan view of the handgun brace utilized in and forming part of the assembly of FIG. 2; and, FIG. 5 is an enlarged schematic front elevation of another preferred embodiment of the gun barrel fork utilized in the assembly of the present invention.

Now referring more particularly to FIGS. 1 and 2 of the drawings, a first preferred embodiment of the improved handgun assembly of the present invention is schematically depicted therein. Thus, assembly 10 is shown, which comprises handgun 12 and handgun brace 14. Handgun 12 includes a main body 16, a barrel 18, a butt 20 with grip 22 and a telescope 24 mounted on barrel 18.

Brace 14 comprises a rod 25 having an upraised front portion 26, and intermediate portion 28 and a rear portion 30. Front portion 26 has a gun barrel-holding means releasably connected thereto. Such means comprises an upraised generally U-shaped holding fork 32 releasably secured to portion 26 by a screw 34 connected to fork 32 and depending therefrom through portion 26, to which is threaded a lock nut 36.

Intermediate portion 28 is connected to the rear end of portion 26 and is integral therewith. Intermediate portion 28 slopes downwardly and rearwardly thereof and bears a depending palm grip 38 secured thereto as by screw 40. The bottom of butt 20 rests on the top of portion 28 to steady it.

Rear portion 30 is connected to the rear end of portion 28 and is integral therewith. Rear portion 30 slopes downwardly and rearwardly thereof and bears at its rear end integral brace means in the form of a bent V-shaped fork 42 adapted to cradle the underside of the forearm of a handgun shooter's shooting arm, as shown in dotted outline in FIG. 1.

When brace 14 is used with handgun 12, as shown in FIG. 1, barrel 18 is in fork 32 and bottom of butt 20 sits on portion 28. The shooting hand grips gun 12 while brace 14 is pulled rearwardly relative to gun 12 by the shooter's non-shooting hand on palm grip 38 so that fork 32 abuts the front end of body 16, tightly bracing it. The shooting forearm meanwhile rests solidly on rear fork 42, as shown in FIG. 1. The result is a steady two-handed grip of an improved type so that aiming and shooting accuracy are greatly improved over prior means.

When it is desired to separate handgun 12 and brace 14, brace is merely pulled down below handgun 12 and can then be stored. Brace 14 can be made of a shaped and angled strip of aluminum, wood, steel or the like and in any convenient size and shape. Fork 32 is replaceable with a larger or smaller fork to fit the diameter of whatever handgun 12 is to be used. Brace 14 is inexpensive, durable, simple and efficient.

FIGS. 3 AND 4.

A second preferred embodiment of the improved handgun assembly of the present invention is schematically depicted in FIGS. and 4 of the drawings. Thus, assembly 10*a* is shown. Components thereof similar to those of assembly 10 bear the same numerals but are succeeded by the letter "a". Assembly 10*a* differs from assembly 10 only in the following respects:

a) Handgun 12*a* is a revolver instead of a single-shot weapon, such as is handgun 12;

b) No separate palm grip such as grip 22 is provided; instead, rod 25*a* is a curved wooden tube which can easily be gripped;

c) Front portion 26*a* has a V-shaped forked integral front end 32*a* instead of separate fork 32 ; barrel 18*a* rests therein;

d) Intermediate portion 28*a* has an elongated upper recess 50 through which projects brace pin 54. Pin 54 can slide the length of slot 52 and be releasably locked in place at any desired position by a lock nut 56 threaded on the bottom end 58 thereof below portion 28*a*. Pin 54 releasably abuts the rear end of butt 20*a* to brace it in recess 50. Velcro-type strip 59 on one side of end 26*a* laps over barrel 18*a* and releasably joins velcro-type receptor strip 61 on the opposite side of end 26*a* to hold barrel 18*a* against brace 14*a*.

e) Rear portion 30*a* has fork 42*a* thereof in the form of an upraised U adapted to brace a shooter's shooting wrist; fork 42*a* is releasably connected to portion 30*a* by a screw 60 depending from fork 42*a* down through portion 30*a* and a lock nut 62 releasably threaded on screw 60; and, f) A rear extension 64 is provided in the form of a rod 66 releasably secured by a front threaded screw 68 to the rear end of portion 30*a*. Rod 66 bears on its rear end a V-shaped integral bracing fork 70 adapted to hold brace 14*a* steady against the forearm or upper arm of the shooting arm.

Assembly 10*a* has the other advantages and mode of operation of assembly 10. It can be made of similar materials.

FIG. 5.

Figure 5:
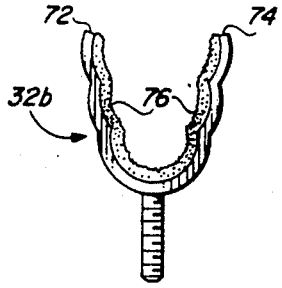
Figure 3:
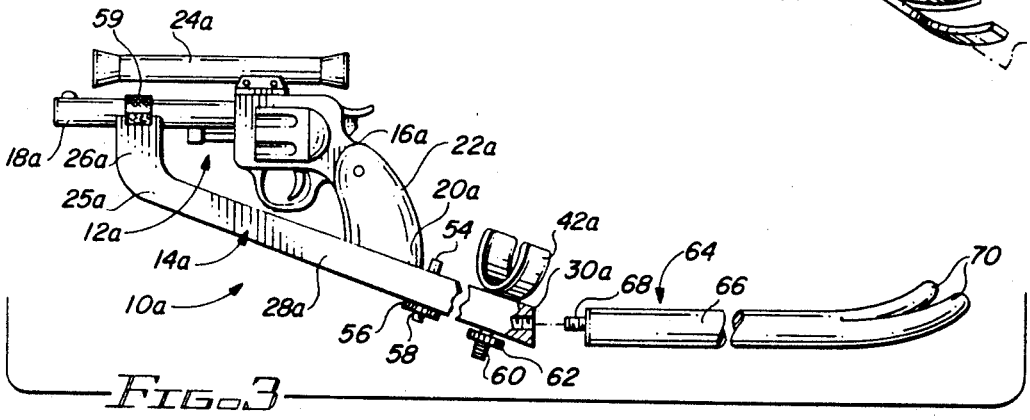
FIG. 3 is a schematic fragmentary side elevation, partly broken away, of a second preferred embodiment of the improved handgun assembly of the present invention, shown with a rear extension brace.

A modified version of the barrel fork used in the brace of the present invention is schematically depicted in FIG. 5. Thus, fork 32*b* is shown, with depending screw and lock nut. Fork 32*b* narrows from top to bottom in a series of arcs, that is, it is stepped, so that it will accommodate handgun barrels of various diameters. In order to facilitate a snug fit between fork 32*b* and the gun barrel, tines 72 and 74 of fork 32*b* are lined with a layer 76 of flexible resilient elastomeric material, such as foamed rubber or plastic or the like. Fork 32*b* can be substituted for fork 32 in assembly 10.

Various other modifications, changes, alterations and additions can be made in the improved assembly of the present invention, its components and their parameters. All such modifications, changes, alterations and additions as are within the scope of the appended claims form part of the present invention.

PRIOR ART STATEMENT

Applicant has not searched the prior art and knows of no relevant prior art. Accordingly, it is believed that the novel handgun brace of the present invention and the handgun assembly employing the same are clearly patentable.

What is claimed is:

1. An improved handgun brace adapted to be releasably held against a handgun having a butt, body and barrel, said brace comprising, in combination:

a) an elongated rod having an upraised front portion, an intermediate portion connected to said front portion and sloping downwardly and rearwardly therefrom, and a rear portion connected to said intermediate portion and extending downwardly and rearwardly from said intermediate portion;

b) an upraised fork connected to said front portion and adapted to releasably support the barrel of said handgun, said fork being stepped to accommodate handgun barrels of various diameters;

c) said intermediate portion being adapted to support the butt of said handgun; and d) means connected to said rear portion and adapted to brace said rod only against a handgun shooter's shooting forearm.

2. The improved handgun brace of claim 1 wherein said barrel support fork is lined with elastomeric material to facilitate a snug fit between said fork and said handgun barrel.

3. An improved handgun assembly, said assembly comprising, in combination:

a) a handgun having a barrel and a butt which includes a handgrip; and, b) a handgun brace resting against but otherwise connected to said handgun, said brace comprising, in combination:

i.) an elongated rod having an upraised front portion, an intermediate portion connected to said front portion and sloping downwardly and rearwardly therefrom, and a rear portion connected to said intermediate portion and extending downwardly and rearwardly therefrom;

ii.) a stepped barrel fork accommodating various barrel diameters connected to said front portion and releasably supporting said handgun barrel, iii.) said intermediate portion supporting said handgun butt, and, iv.) means connected to said rear portion and adapted to brace said rod against a handgun shooter's shooting arm.

4. An improved handgun brace adapted to be releasably held against a handgun having a butt, body and barrel, said brace comprising, in combination:

a) an elongated rod having an upraised front portion, an intermediate portion connected to said front portion and sloping downwardly and rearwardly therefrom, and a rear portion connected to said intermediate portion and extending downwardly and rearwardly therefrom;

b) an upraised fork connected to said front portion and adapted to releasably support the barrel of said handgun;

c) said intermediate portion being adapted to support the butt of said handgun; and, d) a forked arm grip connected to said rear portion and adapted to brace said rod against a handgun shooter's shooting forearm.

* * * * *